US006155272A

United States Patent [19]

Hall et al.

[11] Patent Number: 6,155,272

[45] Date of Patent: Dec. 5, 2000

[54] DEVICE FOR PERMANENTLY WAVING HAIR

[76] Inventors: David Hall; Brenda Hall, both of 7810 Florida Blvd., Denham Springs, La. 70726

[21] Appl. No.: 09/399,396

[22] Filed: Sep. 20, 1999

Related U.S. Application Data

[63] Continuation-in-part of application No. 09/245,688, Feb. 6, 1999, Pat. No. 6,026,826.

[51] Int. Cl.[7] ..... A45D 6/16

[52] U.S. Cl. ..... 132/252

[58] Field of Search ..... 132/207, 249, 132/250, 252, 253, 254, 260, 262, 267, 268, 222, 255, 221

[56] References Cited

U.S. PATENT DOCUMENTS

| | | | |
|---|---|---|---|
| 582,563 | 5/1897 | Wegefarth | 132/255 |
| 1,839,668 | 1/1932 | Gaire | 132/252 |
| 2,429,176 | 10/1947 | Watson | 132/252 |
| 2,938,523 | 5/1960 | Solomon . | |
| 3,008,475 | 11/1961 | Solomon | 132/255 |
| 3,067,755 | 12/1962 | Hoffman et al. . | |
| 3,367,345 | 2/1968 | Riley . | |
| 3,530,863 | 9/1970 | Foster et al. | 132/222 |
| 3,960,156 | 6/1976 | Thompson | 132/222 |
| 4,603,706 | 8/1986 | Caruso | 132/252 |
| 4,989,621 | 2/1991 | Keller | 132/254 |
| 5,467,788 | 11/1995 | Kimura | 132/254 |
| 5,474,096 | 12/1995 | Dohmen | 132/252 |
| 5,819,760 | 10/1998 | Wimer | 132/207 |
| 5,829,455 | 11/1998 | Bauer | 132/207 |

FOREIGN PATENT DOCUMENTS

| | | | |
|---|---|---|---|
| 461553 | 12/1991 | European Pat. Off. | 132/249 |
| 552593 | 12/1959 | France . | |
| 1046846 | 12/1958 | Germany | 132/249 |
| 3616076 | 11/1987 | Germany . | |

*Primary Examiner*—Todd E. Manahan
*Attorney, Agent, or Firm*—Keaty Professional Law Corporation

[57] ABSTRACT

A hair rod for permanently waving hair has a hollow body rod and a cap, secured to the body by an elastic band. A first and second end plates are positioned on respective ends of the body. A plurality of outwardly extending projections formed on an outer surface of the body between the first and the second end plates facilitate retaining of hair on the rod during the rolling process. The body has an elongated opening for receiving and retaining perm paper on the rod and a plurality of through openings to facilitate rinsing of liquid solutions from the hair. The hollow cap has large openings and a plurality of outwardly extending longitudinal and cross ribs that facilitate retaining of liquid solutions on the hair. The cap has a lengthwise slit, and is sufficiently resilient to permit the lengthwise slit to be selectively widened to snap over the body to thereby closely encircle the body and help retain rolled hair on the rod body.

2 Claims, 1 Drawing Sheet

DEVICE FOR PERMANENTLY WAVING HAIR

CROSS-REFERENCE TO RELATED APPLICATIONS

This application is a continuation-in-part of our application Ser. No. 09/245,688 filed on Feb. 6, 1999 now U.S. Pat. No. 6,026,826 entitled "A Device for Permanently Curling Hair," the full disclosure of which is incorporated by reference herein.

BACKGROUND OF THE INVENTION

The present invention relates to hair styling accessories, and more particularly to hair rod devices for permanently curling or waving hair in a process that uses chemical compounds for retaining the curls.

During the history of mankind, many cultures considered wavy or curly hair a desirable feature, and numerous devices and methods were invented for curling hair. Some of the most recent methods strive to achieve a "permanent" waving of hair using a special chemical solution, the so-called perming solution, for wetting hair and imparting a permanent wave to the hair. This method employs the use of a plurality of perming rods. In this method, a particular type of paper, known as perm paper, is folded around the ends of separated wet strands of hair. The perm paper and strands of hair are then rolled onto a perming rod. The perm rod, hair and perm paper are secured, such as by a rubber band, so that the hair is held in a rolled up configuration.

Once the strands of hair have been prepared, the perming solution is applied to the hair. The perming solution is allowed to remain on the hair for a pre-determined period of time in order to set the hair in the desired wave. The hair is then rinsed with water to remove the perming solution, leaving curls in the hair. A neutralizing solution is then applied to the rolled hair strands. After approximately five minutes, the hair is thoroughly rinsed with water, and the perm rods and paper are then removed.

A number of problems are frequently encountered in curling hair using the above method, one of which relates to the loss of perming solution. Conventional cylindrical rods form no mechanical barrier for retaining the solution on the rolled hair, and the perming solution tends to drip off the hair causing loss of the active ingredient, as well as some irritation to the user who needs to repeatedly wipe the dripping solution from her neck.

Another problem is associated with keeping the hair rolled on the perm rod, especially short hair. One of the known solution includes the use of a sleeve that is placed over a strand of hair in the beginning of the hair rolling process. Such design is shown in Belgian patent No. 552593. However, both the perm rod and the sleeve illustrated in that patent are solid bodies, making it difficult to rinse off the chemical solution after the curling process has been completed.

The problem of rinsing has been addressed in German application No. 3616-076-A, wherein hollow perming rods are provided with connecting openings for receiving a supply of water. The rinsing water and fixing solutions are supplied from the fluid sources into the hollow body and then rinsed out through the hair wound on the rod. This design does not appear to appreciate the importance of retaining the fixing solution on the hair.

U.S. Pat. No. 4,603,706 issued on Aug. 5, 1986 to Caruso discloses a hair curler used with a steam method. A hollow perforated core is surrounded by a porous sleeve to assist in distribution of steam in axial and radial directions. A casing with longitudinally extending slots is telescoped over the sleeve and then a semi-circular shield is placed over the casing. This design similarly does not appear to appreciate the importance of helping to keep the solution on hair for a desired period of time.

The present invention contemplates elimination of drawbacks associated with the conventional devices and methods and provide a device for permanently curling hair that can minimize the loss of the perming solution by forming barriers for retaining liquid chemical compound on the user's head.

SUMMARY OF THE INVENTION

It is an object of the invention to provide a device for permanently waving hair that facilitates securing rolled hair on the rod.

It is another object of the invention to provide a device for curling hair that facilitates rinsing of hair curled on the rod.

It is a further object of the invention to provide a device for curling hair that minimizes the loss of perming solution.

These and other objects and advantages of the invention shall become apparent from the following general and preferred description of the invention.

Accordingly, a device for curling hair is provided comprising a hair rod, a cap, and a means for attaching the cap to the hair rod. The hair rod comprises a generally cylindrical hollow body. A first end plate is positioned on a first end of the body, and a second end plate is positioned on a second end of the body. The first end plate carries a loop for securing one end of the band, while the second end plate has an opening that communicates with the interior of the rod body.

A plurality of outwardly extending projections are formed on an outer surface of the body between the first and the second end plates to help in frictional contact of hair with the curling rod. The body has a means for receiving and retaining an edge of a piece of perm paper in the rod, said means comprising an elongated slot formed through the body.

A snap cap with a plurality of relatively large openings fits over at least a portion of the hair rod between the first and second end plates. The cap has a lengthwise slit, and is sufficiently flexible and resilient to permit the lengthwise slit to be selectively widened to snap over the body to thereby closely encircle the body with the mesh cap. The cap is provided with outwardly extending longitudinal and cross ribs that form liquid barriers and facilitate retention of liquid solutions on the hair rolled over the hair rod body. The cap carries a second sleeve for attaching a second end of the securing band thereto.

BRIEF DESCRIPTION OF THE DRAWINGS

Reference will now be made to the drawings, wherein like parts are designated by like numerals and wherein.

DETAIL DESCRIPTION OF THE PREFERRED EMBODIMENT

Figure 1:
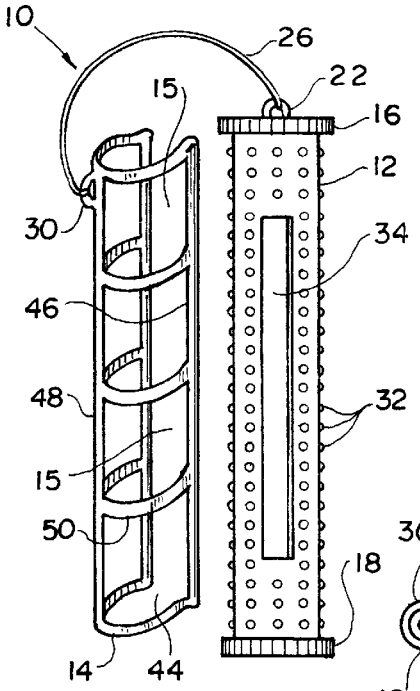
FIG. 1 is a side view of the device in accordance with the present invention showing the hair rod and the snap cap in a disengaged position.

Turning now to the drawings in more detail, the device for waving hair of the present invention is designated by numeral 10. The device 10 comprises a hair rod 10 and a snap cap 14. The hair rod 12 comprises a generally cylindrical hollow body carrying a first end plate 16 on one of its ends and a second end plate 18 on the opposite end of the rod body 10. The end plate 16 is a solid plate, covering a central opening formed in the rod body 12.

The end plate 16 is ring-shaped, encircling the end 20 of the rod 12 and leaving a passage (not shown) to an interior of the rod body 12. The end plates 16 and 18 have greater diameter than the body of the rod 11 to prevent hair from slipping off the rod 12 when wound on the rod, that is when the outer surface of the body 11 located between the end plates 16 and 18 serves as a rolling area for winding hair.

The first end plate 16 carries a loop 22, to which a first end 24 of a securing band 26 is attached. The second end 28 of the band 26 is secured in an attachment loop 30 provided on the cap 14. The securing band 26 serves primarily as a convenience and efficiency feature. For example, a beautician will frequently place a large quantity of rods in a bag for use during the process of curling hair. In curling hair, the beautician will frequently reach into the bag to pull out a rod. Because the cap 14 and rod 12 are attached to one another by the attachment band 26, the beautician does not have to match a cap 14 with a rod 12, thus saving time in the hair curling process.

The band 26 is preferably a band or strip of flexible material, such as rubber, string, plastic, wire, cable, or a combination thereof. The band 26 is preferably elastic, which allows the attachment means 26 to be short in length and stretchable as needed to provide a desired range of movement. The attachment means 26 can be attached to the cap 14 and rod 12 in any manner that allows sufficient movement of the cap 14 relative to the rod 12. For example, the attachment means 26 may be tied or similarly secured to the loops 30 and 24 of the cap 14 and rod 12, respectively.

A plurality of outwardly extending projections 32 are formed on an outer surface of the body 12 between the first and second end plates 16 and 18. When a section of hair is rolled onto the rod 12, in the manner described in further detail below, the outwardly extending projections 32 hold the hair in place, thus substantially preventing the rod 12 from slipping relative to the hair. Once the rolling process is complete, the projections 32 assist in holding the rolled hair on the body 12 until the snap cap 14is placed on the rod 12.

The body 12 is provided with an elongated slot 34 extending in a substantially parallel relationship to a longitudinal axis of the body 12. The elongated slot 34 communicates with the internal chamber 36 of the hair rod 10, and serves primarily to provide a means for receiving and retaining an edge 60 of a piece of perm paper 40 (FIG. 4) on the rod 12. The elongated slot 34 also facilitates the free flow of water or perming (waving) solution through the hair rod 12.

Figure 2:
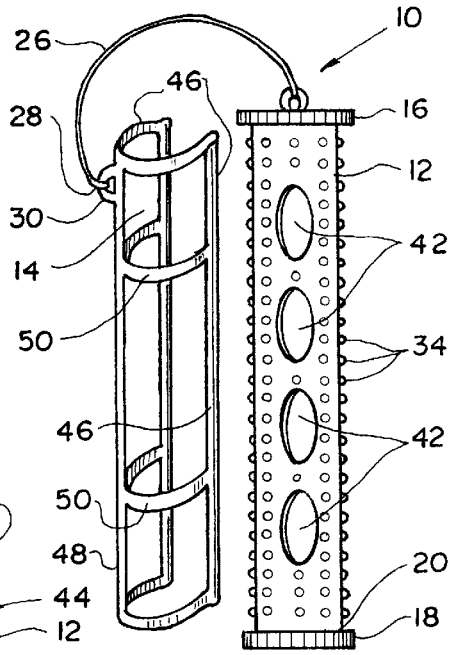
FIG. 2 is a side view of the device of the present invention, rotated one hundred eighty degrees from FIG. 1.

As shown in FIG. 2, the rod 12 is also preferably provided with a plurality of openings 42. The openings 42 extend through the body 12, communicating with the internal chamber 36 to facilitate free water and perming solution flow through the hair rod 12 during a rinsing step. The plurality of openings 42 is preferably arranged in at least one longitudinal row, as shown in FIG. 2. In larger-size rods, the rod 12 can be provided with two or more rows of openings 42, each row spaced about the circumference of the rod 12. The drawings illustrate four oval openings 42, although any other number and shape of the openings 42 may be employed, depending on the manufacturer's preference.

Figure 3:
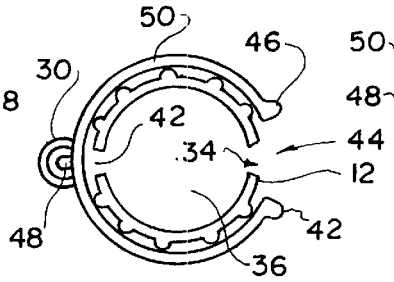
FIG. 3 is a cross-sectional view of the hollow rod body with engaged cap showing the ribbed cap encircling the body of the hair rod.

As shown in FIG. 3, the snap cap 14 is sized to closely encircle at least a portion of the hair rod 12 between the first and the second end plates 16, 18. The snap cap 14 preferably encircles more than one-half, or even more of the entire outer surface of the rod 12. The cap 14 has a lengthwise slot 44. The lengthwise slot 44 allows the cap 14 to be selectively snapped onto and off of the rod 12 as needed during the process of curling hair. The cap 14 is sufficiently flexible and resilient to permit the lengthwise slot 44 to be selectively widened so as to snap the cap over the body 12 to thereby closely encircle the body 12 with the cap 14.

The cap 14 is hollow, comprising a plurality of relatively large openings 15. The number of openings 15 depends on the number of longitudinal ribs 46, 48 and cross ribs 50, as will be explained in more detail hereinafter. The openings 15 facilitate free flow of air, water and perming solution to the hair wound on the rod body 12, as well as efficient rinsing of chemical solutions from the hair.

The edges of the lengthwise slot 44 are provided with outwardly extending ribs 46. The ribs 46 serve as liquid barriers, assisting in retaining of liquid perming solution on the hair. Additionally, the ribs 46 increase strength and durability of the cap 14. An additional liquid barrier 48 is formed on the side of the cap 14 opposite the slot 44. The rib or barrier 48 extends along substantially entire length of the cap 14 in parallel relationship to the ribs 46. Additional horizontal ribs, such as for example rib 49 shown in FIG. 6, may be provided to enhance the liquid-retaining capabilities.

One or more cross ribs 50 are secured between the ends 52 and 54 of the cap 14. The cross ribs 50 strengthen the overall structure of the cap 14. The number of cross ribs 50 depends on the size of the cap 14 and thickness of the material. In some cases, one cross rib 50 is sufficient. In caps of smaller size, where the material is relatively thin, it is preferred to use two or more cross ribs 50.

The snap cap 14 serves to hold the hair on the body 12 and to help retain perming solution on the hair before rinsing. The cross ribs 50, having a certain thickness, will also form barriers to the running liquid, similarly to the ribs 46 and 48.

Figure 4:
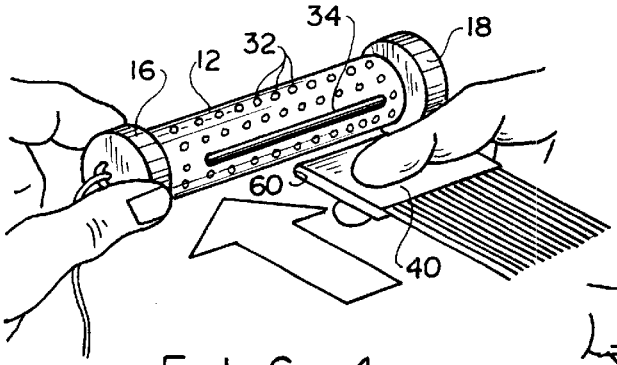
FIG. 4 illustrates a manner of positioning perm paper on the hair and retaining the perm paper on the curling rod of the present invention.
Figure 5:
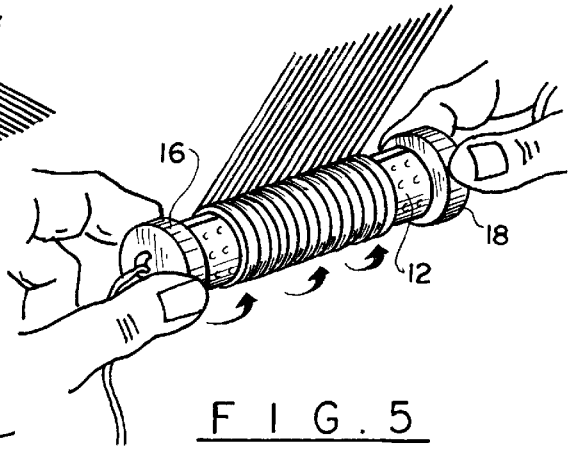
FIG. 5 illustrates the next step in the hair waving process, where a strand of hair is wrapped around the curling rod.
Figure 6:
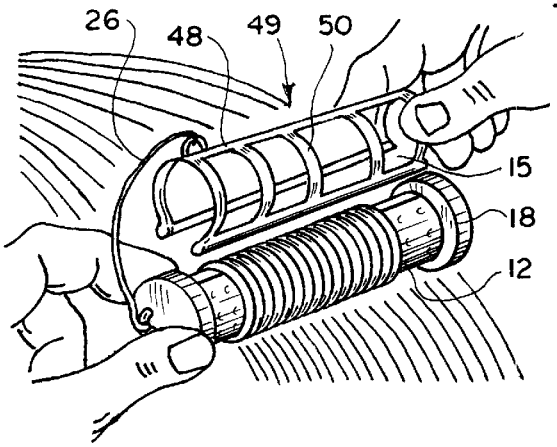
FIG. 6 illustrates another step in the hair curling process, where a snap cap is placed over the hair and the curling rod.

The hair rod body 12 can be manufactured in any convenient size, depending on the type of curl desired. For larger waves, the diameter of the body 12 can be about 1.5 inches, while smaller waves can be made with a rod having a diameter of about 0.25 inch. The end plates, being greater in diameter than the body 11, facilitate retaining of hair rolled over the body 12 and present convenient grasping flanges for use by a hair dresser. As shown in FIGS. 4–6, one or both end plates facilitate handling of the curling device.

The body 12 and the end plates can be made of different materials, such as plastic, rubber and the like. The main requirement, of course, is to have a flexible body that is lightweight and is capable of withstanding repeated chemical applications. Similarly the cp 14 is made from a lightweight material, capable of withstanding repeated widening of the slot 44 when snapped over the rod 12.

FIGS. 4–6 illustrate in more detail the manner of operation of the curling device 10. In operation, the hair curling device 10 of the present invention is used by first separating a strand of hair from a body of hair and folding a piece of perm paper 40 around the end of the strand of hair. A forward edge 60 (FIG. 4) of the perm paper 40 is then placed in the elongated slot 34 of a rod 12 in order to retain the perm paper and the end of the strand of hair on the roller 12.

With the perm paper and hair secured on the rod 12, the perm paper and strand of hair are then rolled onto the rod 12 (FIG. 5). Once the hair has been rolled onto the rod 12, the lengthwise slot 44 of the cap 14 is placed over the rolled hair and the rod 12. Pressure on the cap 14 widens the slot 44, allowing to snap the cap 14 onto the body 12. Once the cap 80 is snapped in place, it encircles the perm paper, the strand of hair, and the body 11 of the rod 10.

Once the strands of hair have been prepared, the perming solution is applied to the hair in the conventional manner. The perming solution is allowed to remain on the hair for a designated amount of time in order to set the hair in the desired wave. The ribs 46, 48, and 50 facilitate retaining of the solution on the hair, forming mechanical barriers to the liquid solution.

The hair is then rinsed with water to remove the perming solution, leaving curls in the hair. A neutralizing solution is then applied to the rolled hair strands. After approximately ten minutes, the hair is thoroughly rinsed with water, and the curling devices 10 and paper are then removed. Because the rod 12 and cap 14 are provided with a plurality of openings, water, perming, and neutralizing solution flow freely through the hair rod and the hair. The elongated slots 34 and the second open end also contribute to the free flow of water through the hair rod and the hair.

The curling rod of the present invention may be also used for a process of straightening, or relaxing hair, wherein a special chemical composition is applied to the hair in order to relax existing curls. The method of using the device of the present invention in this process is basically the same as outlined above, except a different type of chemical lotion is used.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

We claim:

1. A device for permanently waving hair comprising:

a hair rod comprising a generally cylindrical hollow body provided with a means for receiving and retaining an edge of a piece of perm paper, said perm paper receiving means extending in a substantially parallel relationship to a longitudinal axis of said body;

a snap cap sized to closely encircle at least a portion of said hair rod, said cap having a lengthwise slit, said cap being sufficiently resilient to permit said lengthwise slit to be selectively widened so as to snap said cap over said body, said cap being provided with a means for retaining liquid on rolled hair; and a means for attaching said cap to said hair rod, said attachment means comprising a first loop fixedly attached to said first cap, a second loop fixedly attached to an end plate secured on said hollow body and an elastic band secured to said first loop and said second loop.

2. A device for permanently waving hair comprising:

a hair rod comprising a generally cylindrical hollow body;

a means formed in said body for receiving and retaining an edge of a piece of perm paper;

a snap cap sized to closely encircle at least a portion of said body, said cap having a plurality of openings and a lengthwise slit, said cap being sufficiently resilient to permit said lengthwise slit to be selectively widened to snap said cap over said body to thereby closely encirle said body with said cap, said cap being provided with means for retaining of liquid on strands of hair wound about said body, said means for retaining liquid comprising a plurality of longitudinal and cross ribs integrally formed on said cap, said ribs extending a distance outwardly from said cap when said cap is positioned over said rod body and hair wound on said rod body; and an elastic band securing said cap to said hair rod, said elastic band having a first end engageable within a loop attached to an end plate mounted on said body and having a second end engageable to a second loop attached to said cap.

* * * * *